US006637083B1

(12) United States Patent
Howell

(10) Patent No.: US 6,637,083 B1
(45) Date of Patent: Oct. 28, 2003

(54) LANYARD HIGH LOAD TWO PIECE BUCKLE

(76) Inventor: Frank A. Howell, 15 Cotton La., Oxford, ME (US) 04270

( * ) Notice: Subject to any disclaimer, the term of this patent is extended or adjusted under 35 U.S.C. 154(b) by 0 days.

(21) Appl. No.: 10/103,264

(22) Filed: Mar. 21, 2002

(51) Int. Cl.[7] ..... A44B 11/25; A44B 17/00

(52) U.S. Cl. ..... 24/614; 24/615; 24/625; 24/647; 24/664

(58) Field of Search ..... 24/614, 625, 615, 24/647, 664, 701, 265 CD

(56) References Cited

U.S. PATENT DOCUMENTS

| | | | | | |
|---|---|---|---|---|---|
| 3,947,932 | A | * | 4/1976 | Flynn | 24/614 |
| 4,864,700 | A | * | 9/1989 | Kasai | 24/625 |
| 4,924,562 | A | * | 5/1990 | Pogharian | 24/647 |
| 5,435,047 | A | * | 7/1995 | Colpo | 24/647 |
| 5,440,792 | A | * | 8/1995 | Ida | 24/615 |
| 5,832,573 | A | | 11/1998 | Howell | |
| 6,154,936 | A | | 12/2000 | Howell et al. | |

* cited by examiner

*Primary Examiner*—Victor Sakran
(74) *Attorney, Agent, or Firm*—Samuels, Gauthier & Stevens

(57) ABSTRACT

A lanyard, two-piece, high load buckle assembly including a keeper and a cover. The cover is hinged to the keeper and the lanyard is secured thereto. The cover defines an elongated slot. The cover has a cam surface formed on the under surface thereof and terminates in a locking surface. An opening is formed in the cover. The assembly also contains a secure part which includes a base and a tongue section extending from the base. The tongue section has parallel guide arms extending from a rear wall and terminating in leading ends. A member secured to the guide arms is configured with reference to the slot to remove debris from the slot through the opening in the cover. A cam surface formed in the tongue section terminates in a catch surface, such that when the secure part is received in the keeper, the cam surfaces engage and the cover deflects upwardly. The catch surface extends beyond the locking surface and the cover closes fastening the secure part to the keeper.

12 Claims, 7 Drawing Sheets

LANYARD HIGH LOAD TWO PIECE BUCKLE

BACKGROUND OF THE INVENTION

1. Field of the Invention

The invention relates to quick release buckles for backpacks and the like.

2. Description of the Relevant Art

Web straps on light weight backpacks, rucksacks and hiking packs typically use "side-action" buckles to allow shoulder, compression and/or large pocket straps to be parted. This side-action buckle design has significant limitations when used in this capacity. The release tabs are recessed onto the sides of the buckle so they can be difficult to find and release when hurried or when wearing winter gloves. Both release tabs must be squeezed simultaneously toward each other to part the buckle. The hand force required to push the halves together and lock them cannot be increased/decreased without a proportional impact on the hand force required to unlock them. When separated, the exposed locking tabs of the male-half (tongue) of the buckle can be easily broken off and the female-half (body) can be crushed if stepped on. U.S. Pat. Nos. 5,832,573 and 6,154,936 are believed to be the most relevant prior art.

The present invention is directed to a simpler more rugged buckle for use with load bearing webbing, e.g. for backpacks, such as used in the military.

The quick release buckle described in the '936 patent achieves its performance goals as stated in that disclosure. However, it was discovered that when buckle is down-sized to a one inch strap size or less, in some situations the locking fingers do not have high enough stability to manage high tensile loadings. The locking fingers must be of a minimal length to be flexible enough to snap around the keeper yet stiff enough to not distort to the point where they loose their grip on the keeper surfaces when the buckle assembly is subjected to high loads. For larger buckles, the ratio of finger cross-section to length can be managed. Briefly, the locking fingers are long enough to allow the cross-sections to be robust enough to handle high loading.

In the present invention, the moving locking fingers of the '936 reference are not present. The secure part is characterized by cross-brace guards/guides that provide the structural stability needed to facilitate very high load bearing on the secures locking surface. The body and flex surface of the keeper part is modified from the prior art device such that the keepers are configured such that the cover is pushed upwardly as the secure part is inserted and the keeper snaps downwardly to lock when the secure part is fully inserted. The insertion force and release force are both dependent upon the stiffness of the keeper's cover. This provides for high load bearing in small buckle applications. The leading guards/guides on the secure part flex against centered load posts on the keeper.

When fully inserted, the keeper's top snaps down to lock the two parts together while the guard/guides are flexing under insertion loading. When the insertion force is removed, the guard/guides continue to push the secure part against the keeper eliminating any rattle. While under tension from the guards/guides, when the keeper's lever is pulled upwardly and the buckle assembly is not under tension, the secure part is forced back and away from the keeper unlocking the buckle.

Another feature of the invention is that debris such as snow, ice, dirt, etcetera will be ejected both as the secure is inserted into the keeper part where the debris is pushed out of the top of the keeper through an opening. The leading edge of the guides/guards pushes the debris to the back of the keeper where the curved profile of the back wall forces it upward and outward through openings in the top of the keeper's flex lever. When the secure is withdrawn from the keeper, the guards/guides carry before them debris which is withdrawn from the keeper and discharged. The flex guards drag the debris from the keeper.

In another embodiment of the invention, a strap locking system is formed either at the rear portion of the keeper and/or secure. At the rear portions of either or both the keeper and the secure are slots in which slots are formed saddles. Straps which secure the keeper and secure pass through and over (are looped around) the saddle. Usually one strap is stitched (fixed) in place and the other end is adjustable. To adjust the strap, the secure is angled, the pinch pressure is reduced, the strap can slip over the saddle until the desired length is reached and the secure is released and the pinch restored. With a lanyard buckle, pulling the lanyard typically rotates the buckle. This movement inherently tends to slip the strap. In this embodiment, teeth angled at 45° are formed in the saddle. When the lanyard is pulled as the buckle turns, the teeth rotate and seat into the strap preventing any movement. After the teeth seat and the buckle returns to its normal position it is subjected to intermittent loads during normal use.

With prior art buckles, these intermittent loads cause the adjustable strap to slip or loosen and the strap must be continually adjusted. With the present invention, the teeth prevent this slippage.

Therefore, the teeth prevent slippage under two distinct conditions, when the secure is released from the keeper by the lanyard action and during normal use with intermittent loads.

DESCRIPTION OF THE PREFERRED EMBODIMENT

Figure 1:
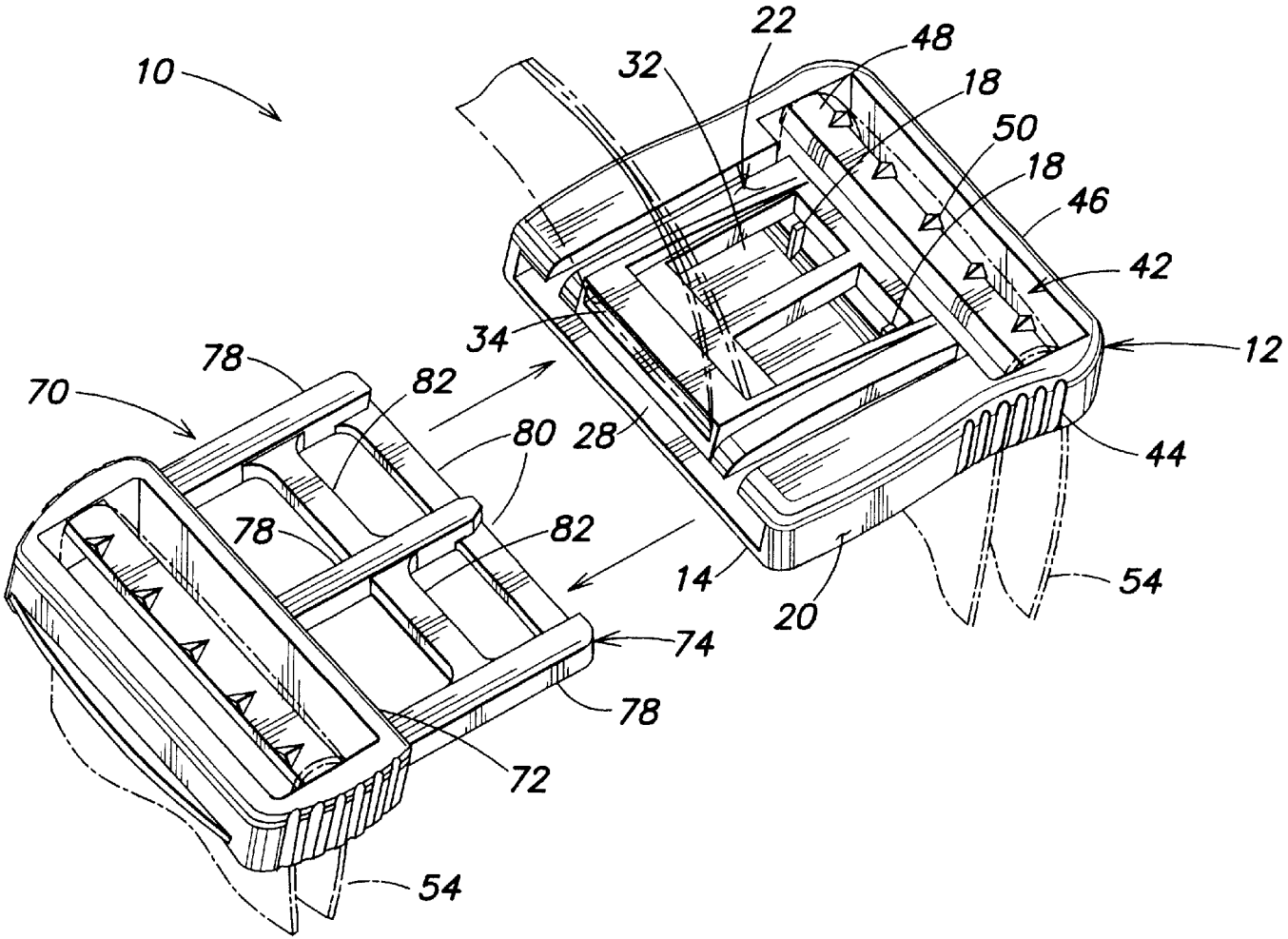
FIG. 1 is a top perspective view of the system.
Figure 2:
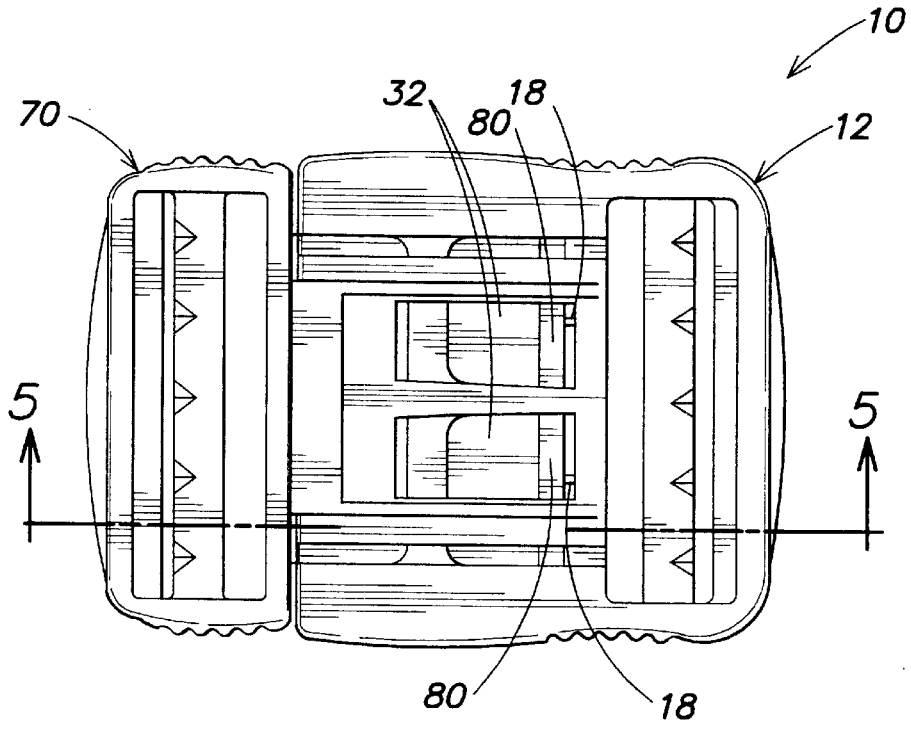
FIG. 2 is a top view of a keeper part and a secure part engaged.
Figure 3:
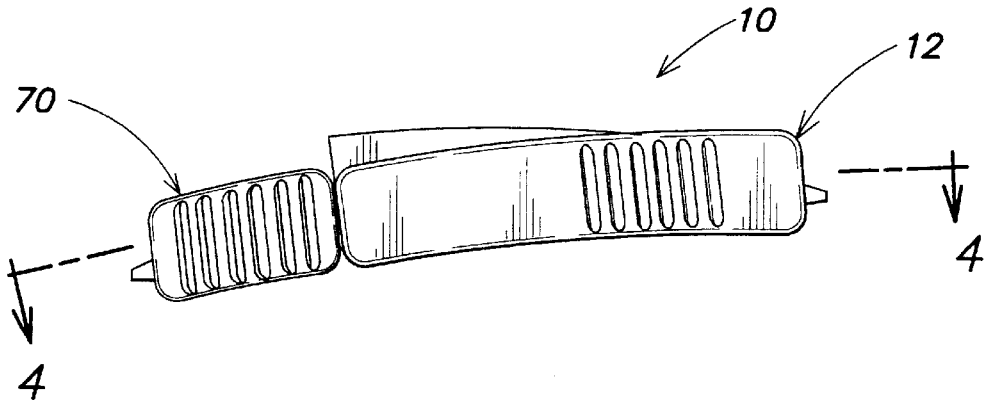
FIG. 3 is a side view of the keeper part and secure part engaged.

Referring to FIGS. 1–6, the buckle is shown generally at 10 and comprises a keeper 12 and a secure part 70. The keeper comprises a floor 14, a back wall 16, load posts 18, side walls 20 and a cover 22. The cover comprises a back edge 24, a front edge 26 and a flex line E.

Figure 5:
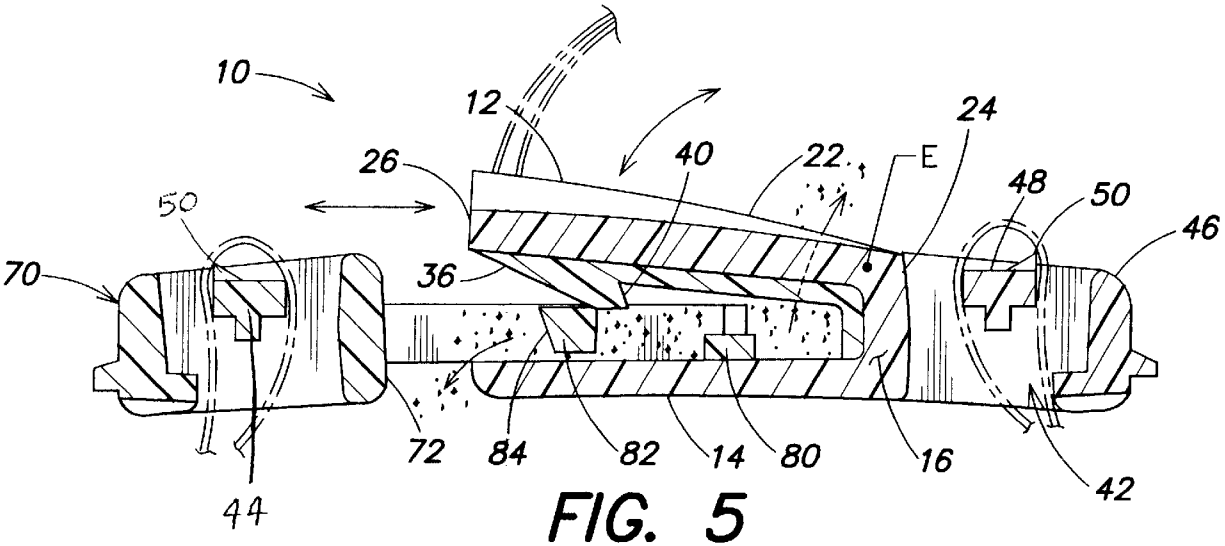
FIG. 5 is a sectional view taken along lines 5—5 of FIG. 2 showing the secure partly engaged.
Figure 6:
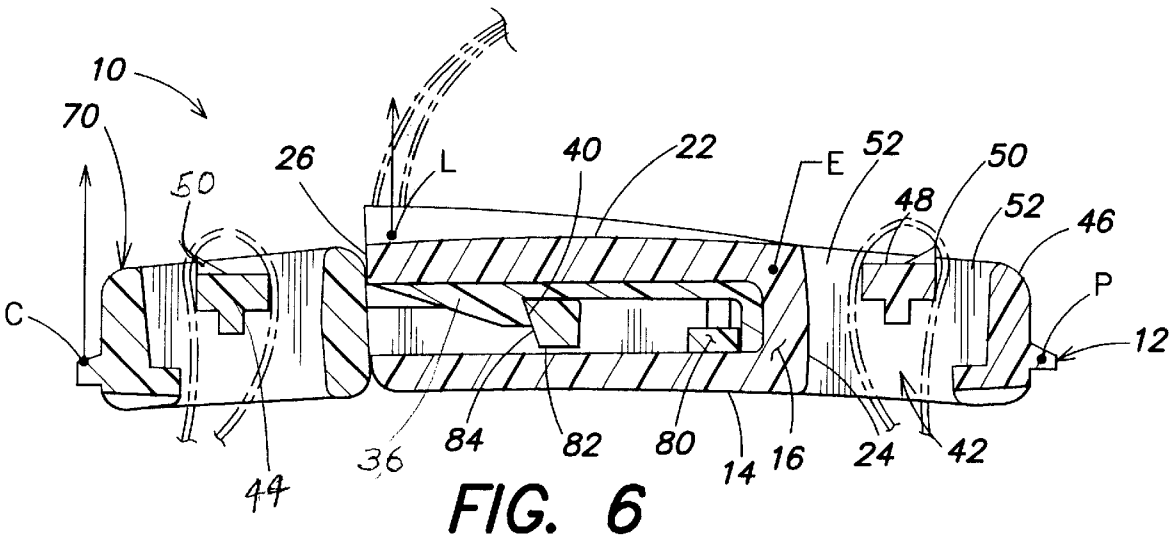
FIG. 6 is a sectional view taken along lines 5—5 of FIG. 2 with the secure part engaged, shows the locking clearance as well as the pivot point.

Referring to FIG. 1, the cover 22 defines with the floor 14 and walls 20, an entrance slot 28. Openings 32 and a lanyard slot 34 are formed in the cover 22. Referring to FIGS. 5 and 6, parallel guide ramps 36 define a slot 38 therebetween. The guide ramps 36 terminate in catch surfaces 40.

Extending from the back wall 16 is a strap locking section 42 having side walls 44, a back wall 46 and a saddle 48 characterized by 45° angled pyrimidal shaped projections 50 extending therefrom. Access openings 52 are defined on either side of the saddle and an adjustment strap 54 passes around the saddle, see FIGS. 7 and 8.

Figure 4:
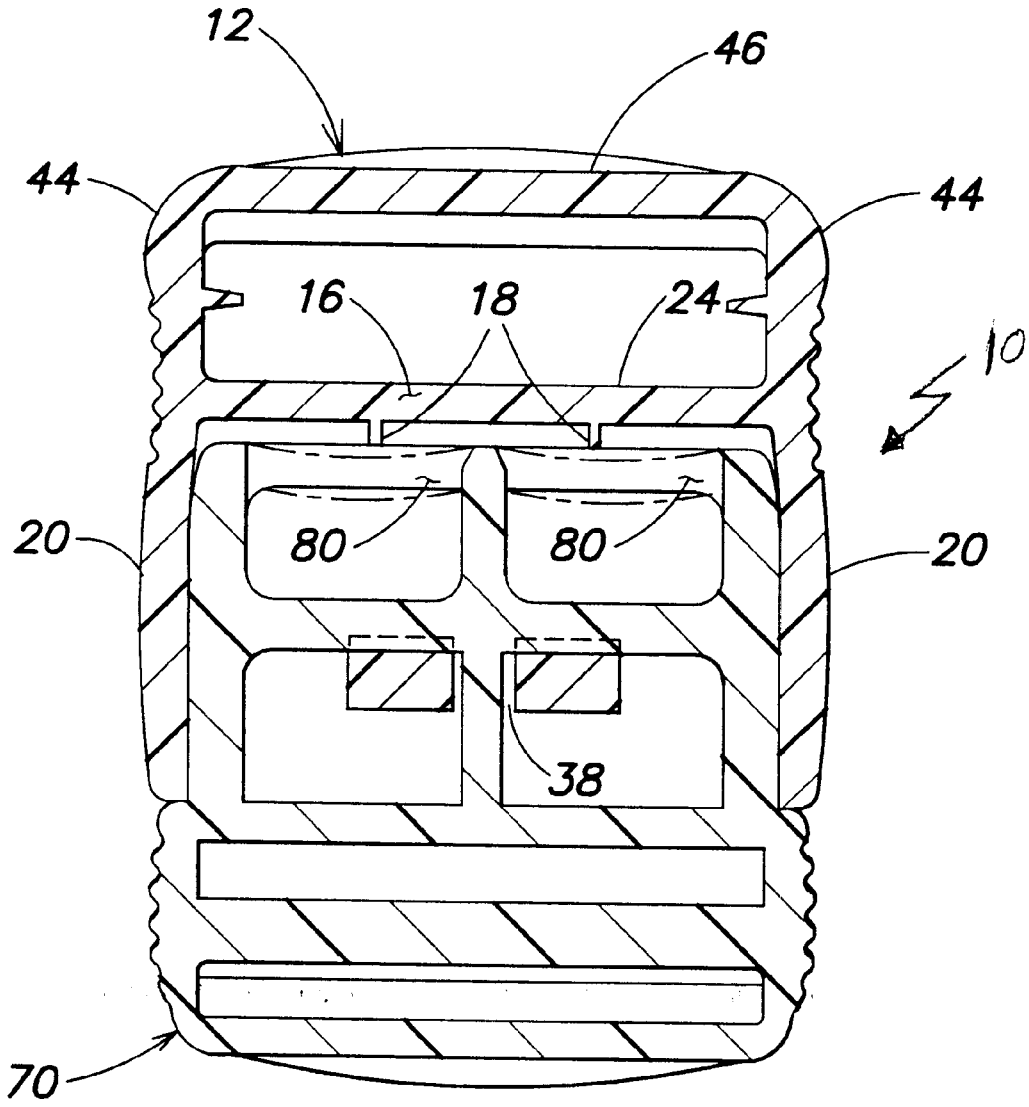
FIG. 4 is a sectional view taken along lines 4—4 of FIG. 3.

Referring to FIGS. 1–6, the secure part 70 comprises a rear wall 72 with a U-shaped tongue section 74 extending therefrom. There are three parallel guide arms 78. One end of the guide arms 78 is secured to the rear wall 72 and the other ends of the guard arms 78 have secured thereto flex members 80. As shown in FIG. 4, the members 80 in the locked position of the buckle 10 engage the load posts 18 and are flexed. Intermediate the rear wall 72 and the members 80 and secured transversely to the arms 78 are locking cross braces 82 which engage the paired sloped ramps 36 of the cover 22 as shown in FIG. 5. The members 82 have angled locking surfaces 84.

Secured to the rear of the rear wall 72 is a strap assembly as described for the keeper.

The catch surfaces 40 and the catch surfaces 84 are mirror imaged angled with reference to one another. A suitable range of angles is between 5 to 250.

In the operation of the invention, the tongue section 74 is inserted into the entrance slot 28. The center guide arm 78 is received in the slot 38 between the parallel guide ramps 36. As the secure 70 continues its travel in the keeper 12, the cross braces 82 engage the ramps 38 deflecting the cover 22 upwardly along the flex line E. The secure 70 continues its travel inwardly with the cross braces 80 sliding past the keeper surfaces 40 while the members 80 engage the posts 18 and are flexed by the posts 18. The cover 22 closes with the catch surfaces 40 and locking surfaces 84 engaging one another. The engagement of the members 80 with the load posts 18 biases the secure 70 in a rearward direction, thus securely holding the keeper and the secure part together without rattle.

To disengage the secure 70 from the keeper 12, the lanyard L is drawn upwardly. The engaged catch/locking surfaces 40/84 slide by one another and the bias exerted by the members 80 on the load posts 18 facilitates removal of the secure from the keeper.

Referring to FIGS. 5–8, the pyrimidal teeth 50 engage the strap 54. When the lanyard L is pulled to release the secure 70 from the keeper 12 the buckle 10 has a tendency to rotate upwardly as shown by the arrow in FIG. 8. When the lanyard is pulled, "P" represents a pivot point. If the strap 54 is to be adjusted, the sides of the secure 70 are pulled upwardly at "C" to reduce the pinch pressure. The secure 70 is released by pulling upwardly at "L". The teeth 50 are between C and P. Pulling the lanyard at L does not change the pinch angle as much as an upward force at C. However, there is still rotation. When the lanyard is pulled, the teeth 50 set into the strap 54 and prevent unwanted displacement around the saddle 44 when the lanyard is pulled. Also, whether or not the lanyard has been pulled, the teeth 50 will seat in the strap 54 during normal use where there is continual intermittent loads on the strap and prevent slippage normally incurred with buckles of this type.

Figure 7:
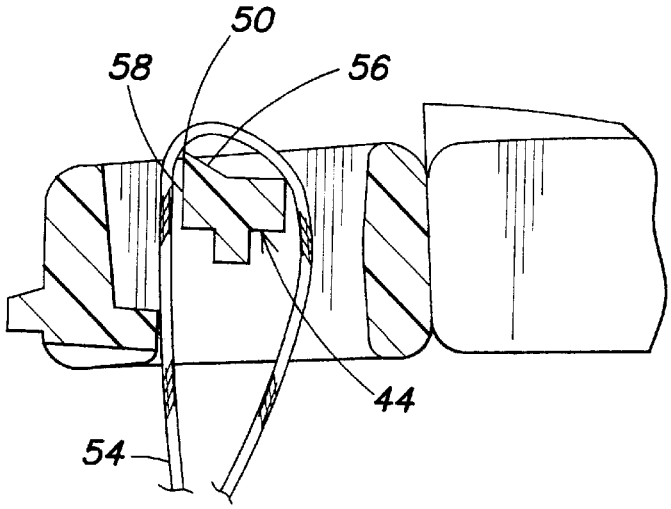
FIGS. 7 and 8 show a strap loose and engaged on a locking structure.
Figure 8:
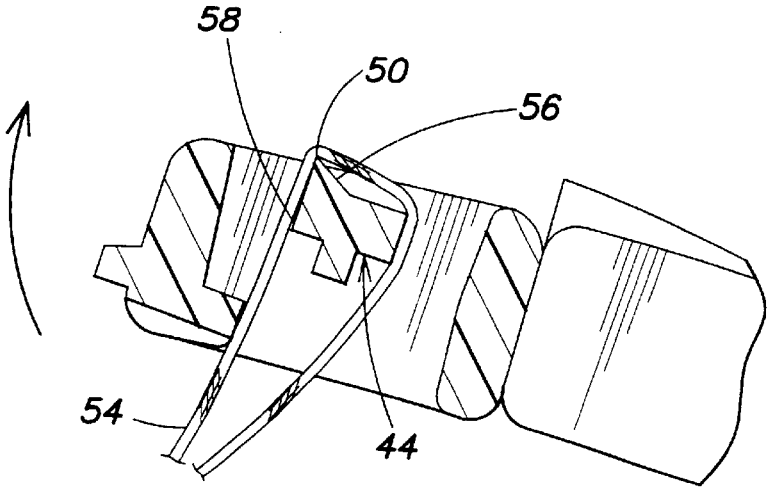

Referring to FIGS. 7 and 8, the shape of the teeth 50 is important. The teeth 50 comprise two slopes 56 and 58. The slope 56, at an angle of about 45°, makes it easier to tighten the strap, while the slope 58, at an angle of about 90°, makes it harder to loosen the strap.

In another feature of the invention, when the secure 70 is inserted into the keeper 12, debris is forced out through the openings 32 in the cover. For any debris remaining in the buckle 10 when the secure 70 is removed from the keeper 12, the members 80, which travel on the surface of the floor 14, carry before them debris which is simply discharged when the secure 70 is removed from the keeper.

Figure 9:
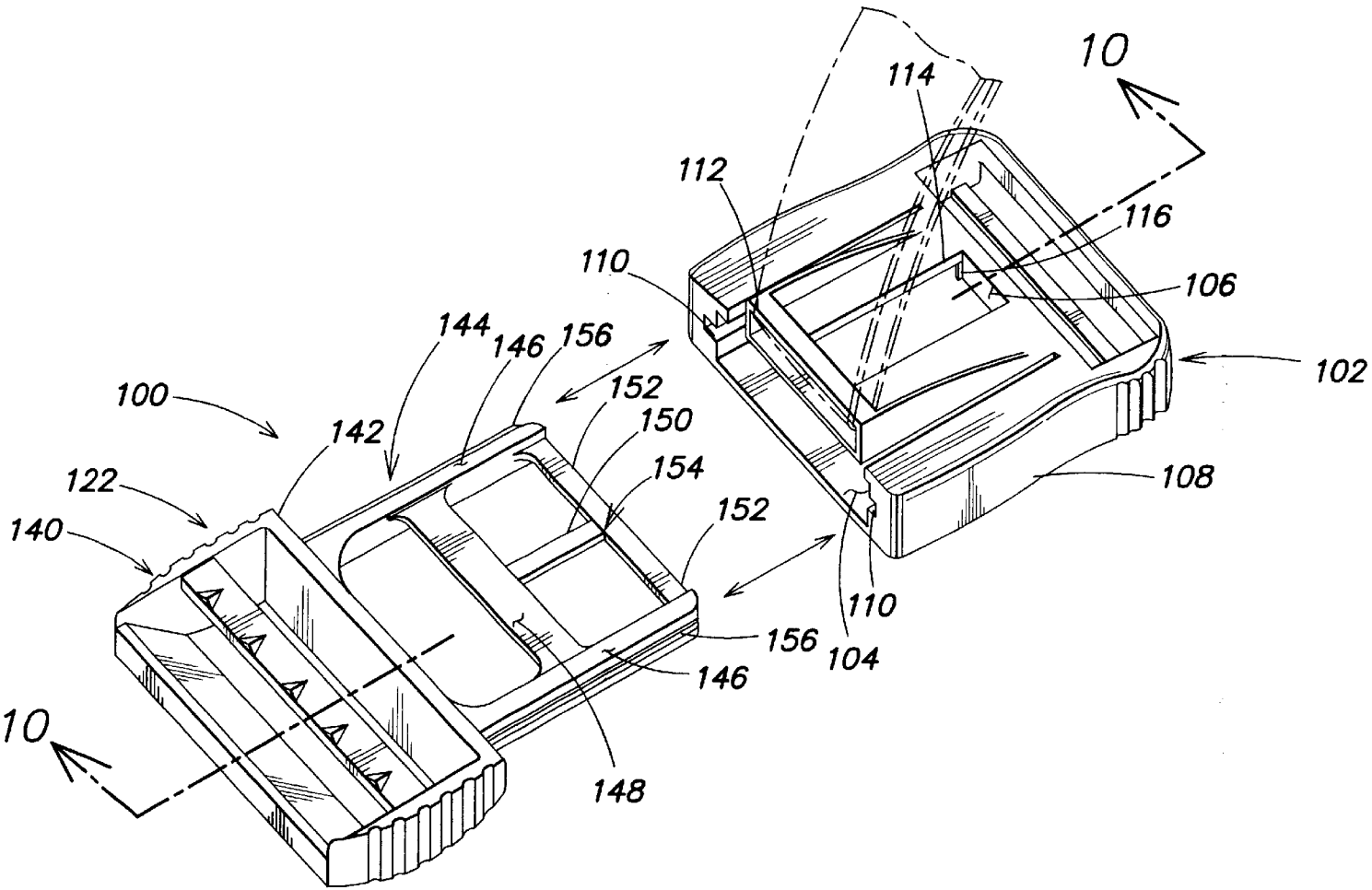
FIG. 9 is a top perspective view of an alternative embodiment.
Figure 10:
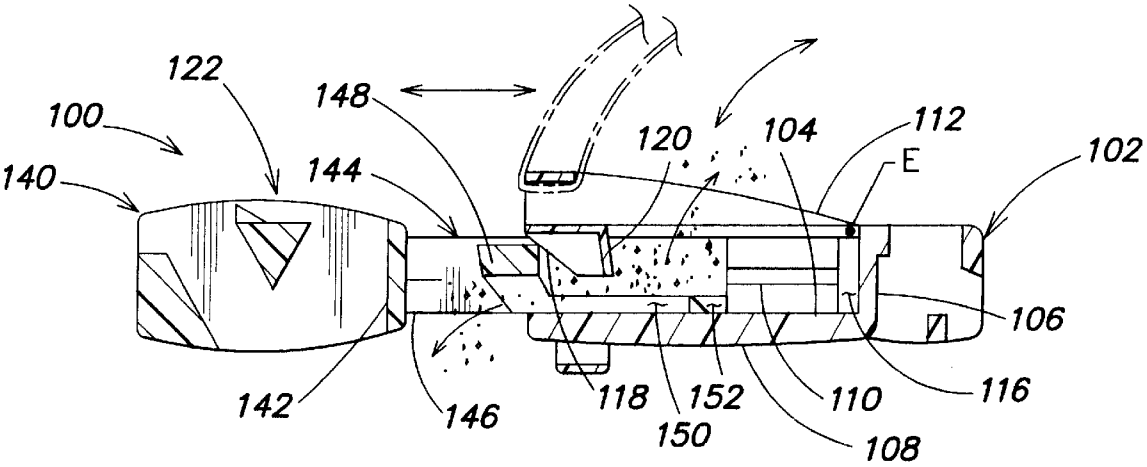
FIG. 10 is a side view of FIG. 9 taken along lines 10—10 the secure entering the keeper.
Figure 11:
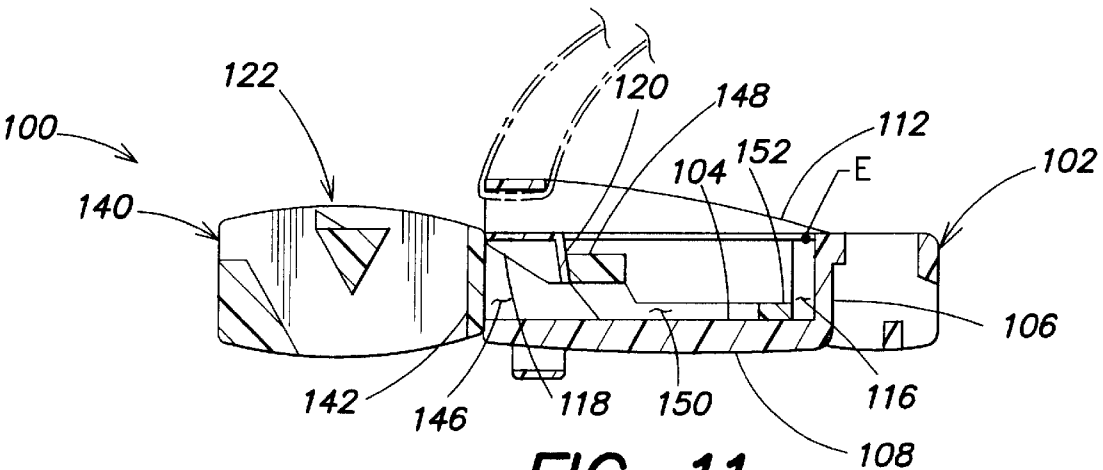
FIG. 11 is a side view of FIG. 9 taken along lines 10—10 the secure locked in the keeper.

In an alternative embodiment of the invention, referring to FIGS. 9, 10 and 11, a buckle is shown generally at 100 and comprises a keeper 102 and a secure 140. The keeper 102 has a floor 104, a rear wall 106, side walls 108 having grooves 110 formed on the inner surfaces of the walls 108, and a cover 112 secured to the rear wall at a flex line E. The cover 112 is characterized by a rectangular-shaped opening 114. The rear wall 106 has flex posts 116 formed therein. The underside of the cover is characterized by a ramped surface 118 terminating in a locking surface 120. A strap assembly 122, shown generally, is as described for the preferred embodiment.

The secure 140 has a rear wall 142, an extending tongue-like section 144 comprising a paired guide arms 146, a cross brace 148, a spade-like guide 150, joined at one end to the cross brace 148 and extending downwardly and forwardly and terminating in a distal end 154, and flex members 152 are joined to the end 154 and the ends of the guide arms 146. The side of the guide arms 146 have rails 156 which mate with the grooves 110.

This alternative embodiment functions as the preferred embodiment with the flex posts 116 exerting a biasing effect on the flex members 152 when the buckle 100 is in the locked position. The strap locking systems of the preferred and alternative embodiment are identical. The debris cleaning functions are substantially the same. Namely, debris is removed both during insertion by the flex members pushing debris before it and out through the opening in the cover and during release when the flex members push before it on the floor of the keeper any debris.

The invention has been described with reference to the cross member of the secure engaging a caming or ramped surface on the underside of the cover of the keeper, in order to enable the secure and the keeper to engage to one another. The secure could have a caming or ramped surface and the keeper a flat surface or both the secure and the keeper could have mating, caming or ramped surfaces.

Although shown and described with reference to the strap locking system on rear or both the keeper and the secure, in practice, it is expected that one of the straps would be stitched and the other of the straps would use the locking system as described.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention what I now claim is:

1. A lanyard two-piece high load buckle assembly which comprises:

a keeper having a rear wall, side walls, and a floor, a cover, to which a lanyard is secured, hinged to the keeper spaced apart from the floor and between the walls, the floor, the walls, and the cover defining an elongated slot;

a cover having a caming surface formed on the under surface of the cover, which caming surface terminates in locking surface, an opening formed in the cover;

a secure part comprising a base, a rear wall a tongue section extending from the base, the tongue section comprising parallel guide arms extending from the rear wall forwardly, and terminating in leading ends, a member secured to the guide arms, the member is configured with reference to the slot to remove debris from the slot through the opening in the cover, a caming surface formed in the tongue section, the caming surface terminating in a catch surface, whereby when the secure part is received in the keeper, the caming surfaces engage and the cover deflects upwardly, the catch surface extends beyond the locking surface, the cover closes fastening the secure to the keeper.

2. The buckle of claim 1 wherein:

the keeper comprises two load posts;

the secure part comprises three guide arms, two outer arms and a center arm, and wherein the members comprise flex members secured transversely to the outer ends of the arms, which flex members engage the load posts when the secure is locked to the keeper.

3. The buckle of claim 2 wherein the cover has at least two openings.

4. The buckle of claim 3 wherein the flex members travel on the floor of the keeper whereby debris is removed from the buckle when the secure is disengaged.

5. The buckle of claim 2 wherein the locking surface and the catch surfaces are mirror imaged angled with reference to one another.

6. The buckle of claim 2 wherein the caming surface comprises:

a center groove formed therein and the center guide arm is received in the groove.

7. The buckle of claim 2 wherein the cross brace engages the caming surface on the cover.

8. The buckle of claim 1 wherein the inner surface of the walls of the keeper are characterized by grooves and the outer surfaces of the guide arms are characterized by mating rails.

9. The buckle of claim 8 wherein a center guide extends from the cross brace and terminates in a distal end and the flex members are secured transversely to the distal end and the guide members.

10. The buckle of claims 1, 2, 3, 4, 5, 6, 7, 8 or 9 wherein the keeper and the secure part each have a rear wall and which comprises:

a strap locking section attached to one of said rear walls, the section having a saddle formed between two access openings through which a strap passes;

teeth formed on the saddle and angled such that when the lanyard is pulled and the buckle rotates the teeth seat into the strap preventing unwanted movement of the strap; and the teeth remain seated in the strap.

11. The buckle of claim 10 wherein the teeth are pyrimidal shaped teeth.

12. The buckle of claim 11 wherein the teeth extend from the saddle at an angle of about 45° measured with reference to the top surface of the saddle.

* * * * *